US012130014B2

(12) United States Patent
Ochiai

(10) Patent No.: US 12,130,014 B2
(45) Date of Patent: Oct. 29, 2024

(54) IGNITER, IGNITER WITH ADJUSTABLE WICK, AND METHOD OF MANUFACTURING AND OPERATING THE SAME

(71) Applicant: Tokai Seiki Co., (H.K.) Ltd., Tuen Mun (HK)

(72) Inventor: Yuzo Ochiai, Oyama-cho (JP)

(73) Assignee: Tokai Seiki Co., (H.K.) Ltd., Tuen Mun (HK)

( * ) Notice: Subject to any disclaimer, the term of this patent is extended or adjusted under 35 U.S.C. 154(b) by 330 days.

(21) Appl. No.: 17/572,399

(22) Filed: Jan. 10, 2022

(65) Prior Publication Data

US 2023/0220996 A1 Jul. 13, 2023

(51) Int. Cl.
*F23Q 2/18* (2006.01)
*F23Q 2/28* (2006.01)
*F23Q 2/44* (2006.01)

(52) U.S. Cl.
CPC ..... *F23Q 2/18* (2013.01); *F23Q 2/282* (2013.01); *F23Q 2/44* (2013.01)

(58) Field of Classification Search
CPC ..... F23Q 2/18; F23Q 2/44; F23Q 2/282
See application file for complete search history.

(56) References Cited

U.S. PATENT DOCUMENTS 506,347 A 10/1893 Struble
522,727 A 7/1894 Chambers
522,934 A 7/1894 Schimkatt
588,669 A 8/1897 Van Hoevenbergh
(Continued)

FOREIGN PATENT DOCUMENTS

CN 206430192 U 8/2017
GB 373219 * 5/1932
(Continued)

OTHER PUBLICATIONS

"Arc Lighter Stealth Angel Survival", Retrieved from Internet URL : https://www.stealthangelsurvival.com/products/stealth-angel arc-lighter, accessed on Jan. 13, 2022, pp. 9.
(Continued)

*Primary Examiner* — Alfred Basichas
(74) *Attorney, Agent, or Firm* — Shook, Hardy & Bacon L.L.P.

(57) ABSTRACT

Igniters, igniters with adjustable wicks, and methods of manufacturing and operating the same are disclosed. The igniters may include a housing, at least one battery, an ignition assembly, and a wick. The ignition assembly may include a pivot-mechanism having a first pivoting-element, a second pivoting-element, and a pivot-hinge assembly through which the first pivoting-element and the second pivoting-element are rotatably coupled. The ignition assembly can be operated to pivot the first pivoting-element and the second pivoting-element in opposite directions. The ignition assembly may include electrical contacts that can be shifted into contact to complete a circuit, thereby sending an electrical current through an igniter tip used to ignite the wick. In additional aspects, the wick is a hemp wick, and the housing may be formed of biodegradable or recyclable materials.

20 Claims, 9 Drawing Sheets

(56) References Cited

U.S. PATENT DOCUMENTS

| | | | | |
|---|---|---|---|---|
| 1,963,345 | A | 6/1934 | Zwilling | |
| 2,020,142 | A | 11/1935 | Florman | |
| 2,156,586 | A | 5/1939 | Florman | |
| 2,276,039 | A | 3/1942 | Horther | |
| 2,657,340 | A | 10/1953 | Rink et al. | |
| 2,799,810 | A | 7/1957 | Rink et al. | |
| 2,867,753 | A | 1/1959 | Quandt | |
| 3,730,670 | A * | 5/1973 | Lambert | F23Q 2/282 431/256 |
| 3,873,262 | A * | 3/1975 | Pogrell | F23Q 2/282 431/255 |
| 5,221,820 | A | 6/1993 | Shimoji | |
| 5,285,050 | A | 2/1994 | Blackburn | |
| 6,832,910 | B2 | 12/2004 | Chung | |
| 9,187,237 | B1 | 11/2015 | Pedotto, Jr. | |
| 2012/0010071 | A1 | 1/2012 | Mylko | |
| 2012/0315588 | A1 | 12/2012 | Kondrat | |
| 2014/0134545 | A1 | 5/2014 | Stalling | |
| 2014/0291429 | A1 | 10/2014 | Stenstrom | |
| 2016/0040877 | A1 | 2/2016 | Mohamedali | |

FOREIGN PATENT DOCUMENTS

| | | | |
|---|---|---|---|
| GB | 592657 | * | 9/1947 |
| JP | 2003-148730 | A | 5/2003 |
| WO | 95/21513 | A1 | 8/1995 |
| WO | 2007/101367 | A1 | 9/2007 |
| WO | 2012/163246 | A1 | 12/2012 |

OTHER PUBLICATIONS

"Hemp Wick Lighter (BIC)", Retrieved from Internet URL : https://hemplights.com/collections/frontpage/products/wrapper-hemp-wick-lighter-standard-bic, accessed on Jan. 13, 2022, pp. 4.

"SOL-Fire Lite Fuel-Free Lighter", Retrieved from Internet URL : https://www.rei.com/product/188703/sol-fire-lite-fuel-free-lighter, accessed on Jan. 13, 2022, pp. 14.

"Trench Lighter Outdoor Camping with Rope Windproof Kerosene Metal", Retrieved from Internet URL : https://www.etsy.com/listing/918430309/trench-lighter-outdoor-camping-with-rope, accessed on Jan. 13, 2022, pp. 10.

Coleman, G., "How to use hemp wick", weedmaps.com, Retrieved from Internet URL : https://weedmaps.com/learn/products-and-how-to-consume/hemp-wick, pp. 1-4 (2021).

Invitation to pay additional fees received for PCT Patent Application No. PCT/IB2023/050230, mailed on Mar. 31, 2023, 13 pages.

International Search Report and Written Opinion received for PCT Patent Application No. PCT/IB2023/050230, mailed on May 24, 2023, 19 pages.

* cited by examiner

IGNITER, IGNITER WITH ADJUSTABLE WICK, AND METHOD OF MANUFACTURING AND OPERATING THE SAME

TECHNICAL FIELD

The field relates to flame igniters.

BACKGROUND

To selectively ignite different materials, a flame igniter is useful. Traditional lighters rely on sources of fuel, e.g., petroleum-based gas or liquid fuels, which can be undesirable in some circumstances. For example, a lighter that uses such fuel sources can produce combustion byproducts, e.g., heat, fumes, and/or smells. This may be undesirable to some users, among other disadvantages. Therefore, an improved igniter is needed.

SUMMARY

This summary is intended to introduce a selection of concepts in a simplified form, which are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes, among other things, igniters, igniters with adjustable wicks, and methods of manufacturing and operating the same. In one embodiment, an igniter is provided. The igniter may include a housing. The housing may include a first end, a second end, and a tubular-like body extending between the first end and the second end. The igniter may include a power source that is integrated, at least partially, within the housing. The power source may include at least one battery, e.g., a dry-cell battery or pair of dry-cell batteries, which form(s) part of a battery configuration. The battery configuration may include a pair of electrical contacts. The igniter may also include an ignition assembly. The ignition assembly may include ignition components that are coupled to a mechanism, which can be operated to shift the ignition components to facilitate ignition. For example, the shifting of the ignition components may complete an electrical circuit, thereby sending electrical current from the power source to an igniter tip coupled to the ignition assembly. The igniter tip, heated by the electrical current, can then be used to ignite a material, e.g., a wick coupled to the igniter. The igniter may include a wick-feeding mechanism that is operable to extend and retract a wick, to thereby support igniting and extinguishing the wick. The wicks discussed herein may be formed of different materials, e.g., those that are natural, synthetic, or a combination thereof. In addition, in other embodiments, the igniter may not include a wick-feeding mechanism or a wick, and instead, the ignition assembly may be operated to directly ignite combustible materials. The different components of the igniters described herein may be constructed from biodegradable materials, e.g., resin-based materials or paper-based materials, and/or from recyclable materials, among many others.

The term "igniter," as used herein, should be interpreted broadly, to include any one or combination of components assembled into a device that can produce heat useable for ignition of a material.

BRIEF DESCRIPTION OF THE DRAWINGS

The igniters, the igniters with adjustable wicks, and the methods of manufacturing and operating the same are described in detail herein with reference to the attached drawing figures, which are intended to illustrate non-limiting examples, and in which.

DETAILED DESCRIPTION

This detailed description is provided in order to meet statutory requirements. However, this description is not intended to limit the scope of the invention disclosed herein. Rather, the claimed subject matter may be embodied in other ways, to include different steps, combinations of steps, different elements, and/or different combinations of elements, similar to those described in this disclosure, and in conjunction with other present and/or future technologies. Moreover, although the terms "step" and "block" may be used herein to identify different elements of methods employed, the terms should not be interpreted as implying any particular order among or between different elements, except when the order is explicitly stated.

In general, this disclosure describes igniters, igniters with adjustable wicks, and methods of manufacturing and operating the same. The embodiments described herein, some of which are depicted in attached FIGS. 1-8, enable the ignition of different materials, e.g., wicks formed of natural and/or synthetic materials. These embodiments may accomplish this without the use of combustible gases or fuels, allowing for efficient ignition with fewer byproducts of combustion, e.g., heat, fumes, and/or smells, being produced. The igniters described herein may utilize different mechanical and electrical ignition components to facilitate the ignition of materials, as described further below, in connection with FIGS. 1-8.

The igniters described herein, including the embodiments depicted in FIGS. 1-8, may use ignition assemblies that require no combustible fuel for ignition, and instead may rely only on electrical-based components to facilitate ignition, as described herein. For example, unlike traditional fuel-filled "lighters," the embodiments described herein may not require Liquefied Petroleum Gas ("LPG"), Liquid Fuel (e.g., Naptha-type), or other combustible liquids or gases to provide ignition of a flame, and thus under existing classifications, such as those outlined in ASTM-F400, the embodiments described herein may not be classified or characterized as "lighters."

Figure 1:
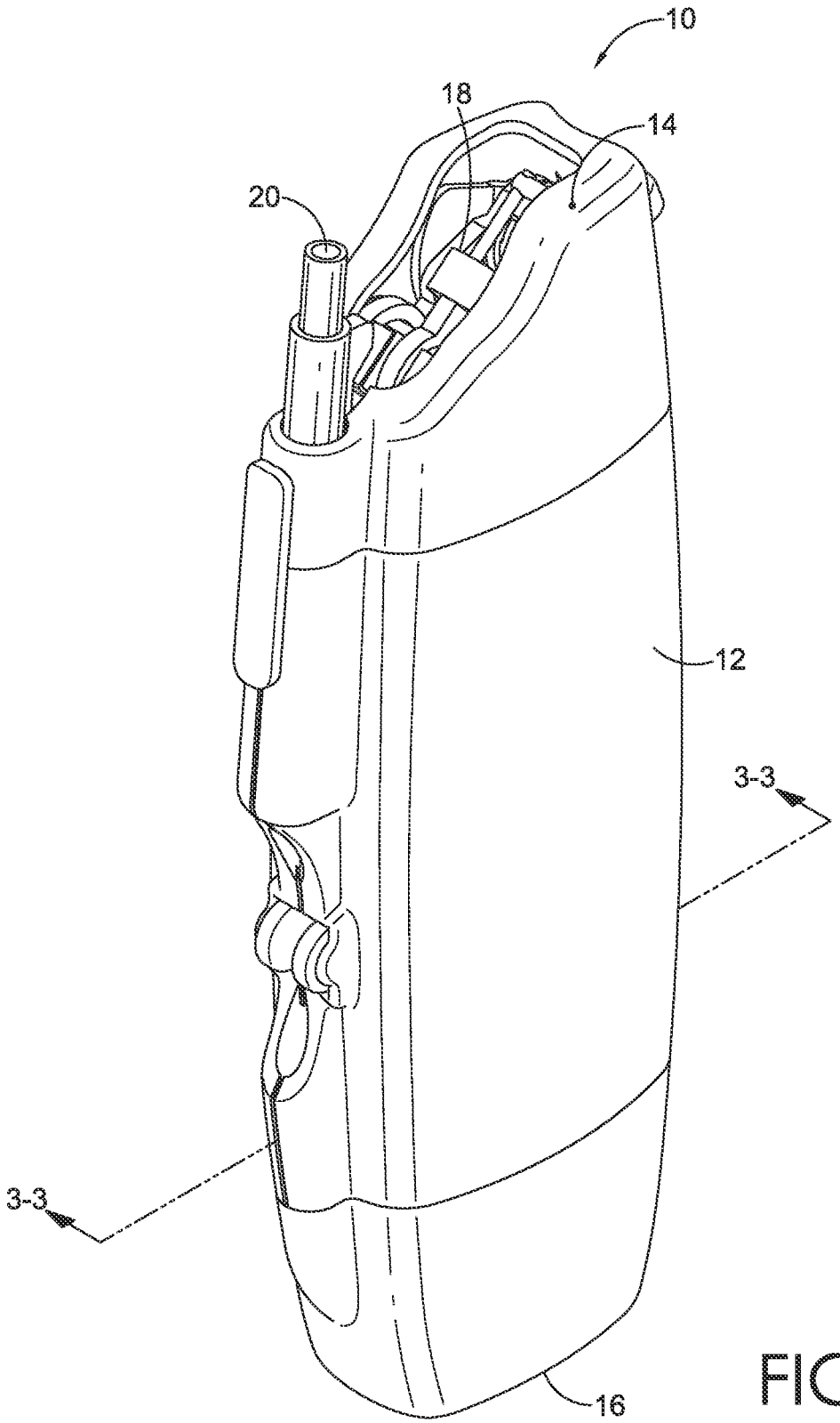
FIG. 1 depicts a perspective view of an igniter, in accordance with an embodiment of the present disclosure.
Figure 2:
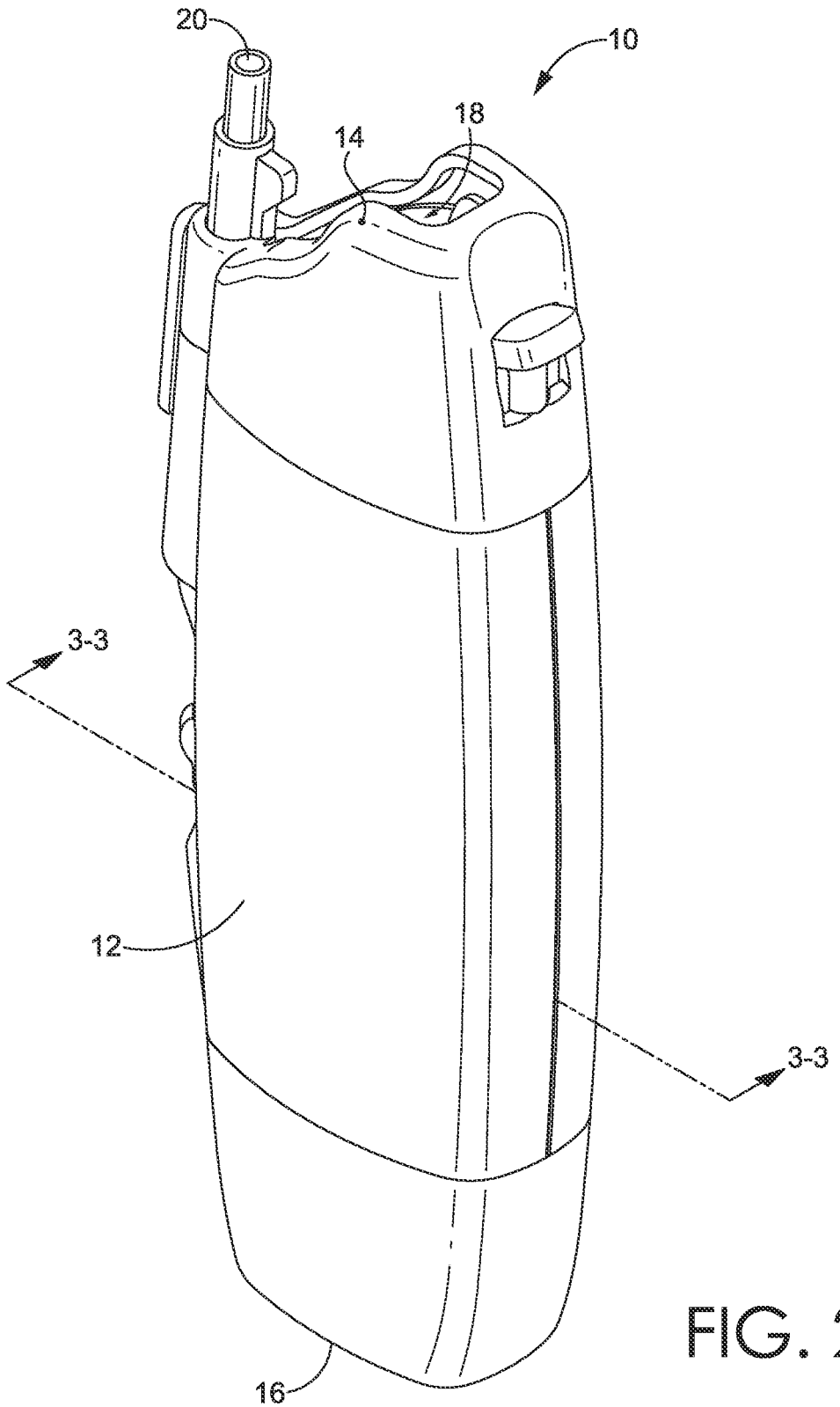
FIG. 2 depicts another perspective view of the igniter shown in FIG. 1, in accordance with an embodiment of the present disclosure.

Looking now at FIGS. 1 and 2, an igniter 10 is shown, in accordance with an embodiment of the present disclosure. The igniter 10 shown in FIGS. 1 and 2 is intended to represent one non-limiting configuration, with many others contemplated herein. The igniter 10 includes a housing 12 with an end 14 and an end 16 that is opposite to the end 14. The igniter 10 also includes an ignition assembly 18 with multiple ignition components (many of which are obscured by the housing 12 in FIGS. 1 and 2). The ignition assembly 18 is used to provide ignition. For example, when a wick, such as the wick 24 shown in FIG. 3C, is fed out of the housing 12, e.g., from the tube 20, the ignition assembly 18 can be operated, thereby igniting the wick. The ignition assembly 18 may then be deactivated, allowing the wick to continue to burn, e.g., for use in igniting other materials. This operation is described in greater detail in connection with FIGS. 3A-3C.

Figure 3A:
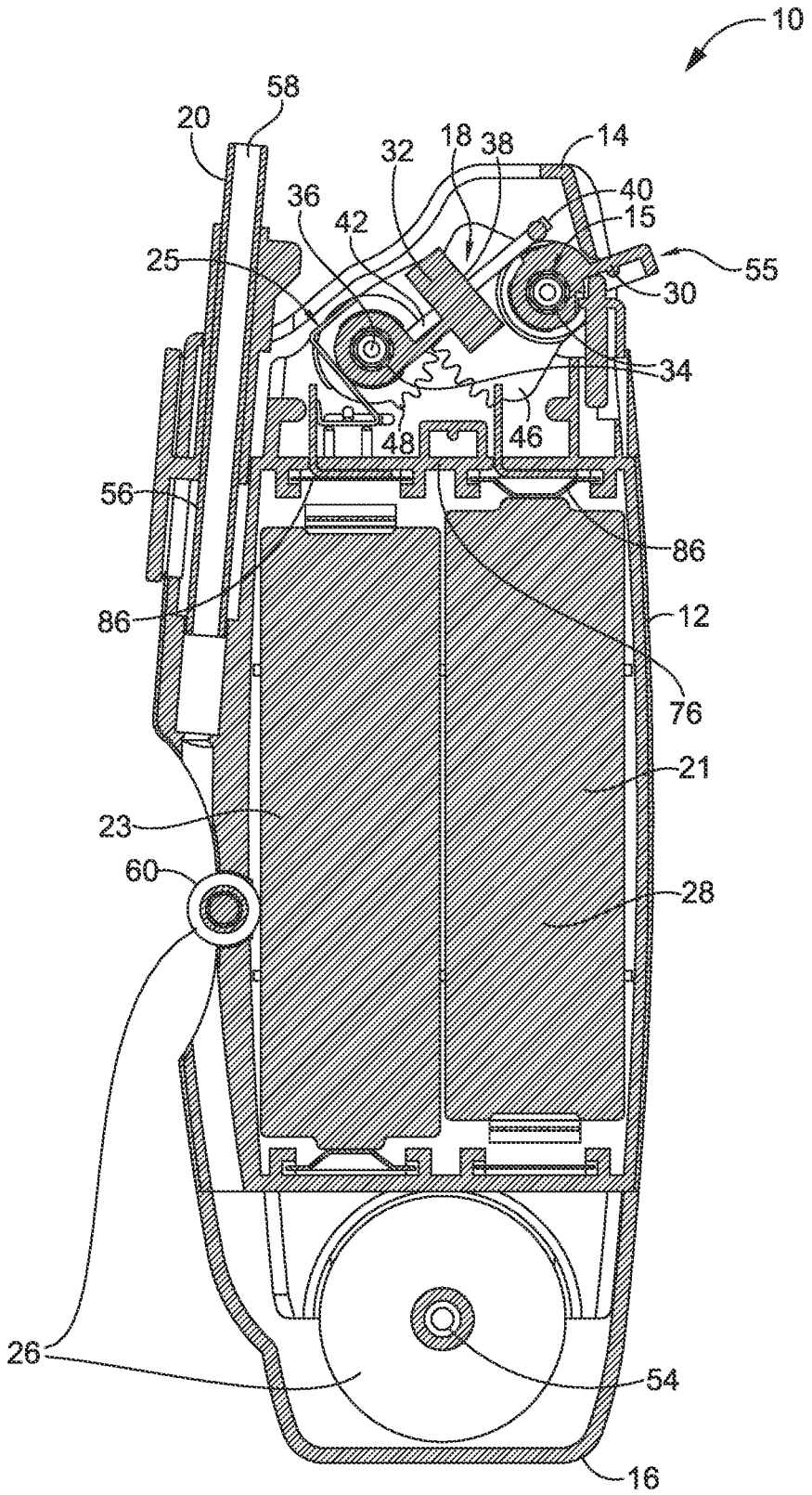
FIGS. 3A-3C depict a series of cross-section views showing the igniter of FIGS. 1-2 in different states of operation, in accordance with an embodiment of the present disclosure.
Figure 3B:
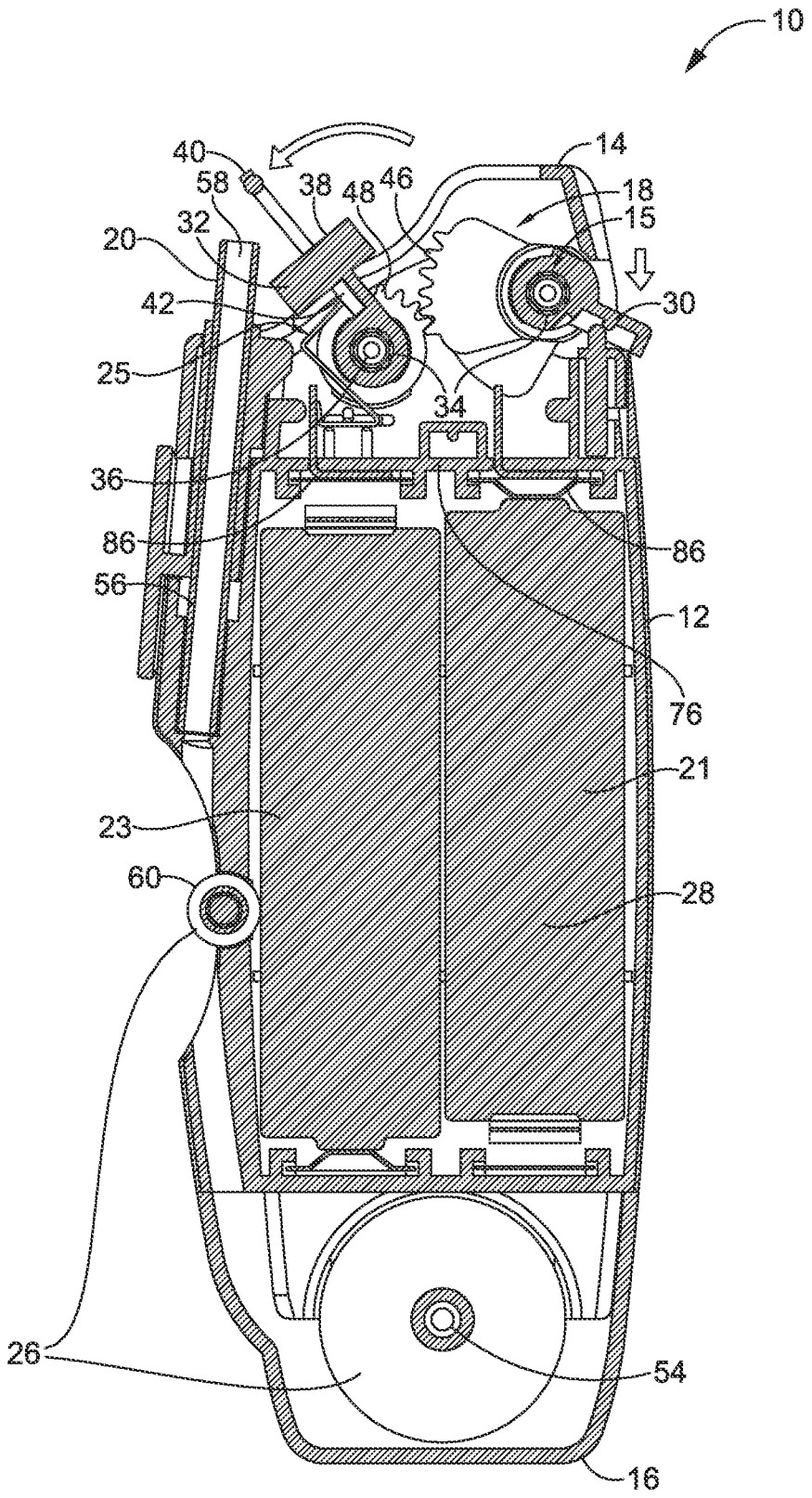
Figure 3C:
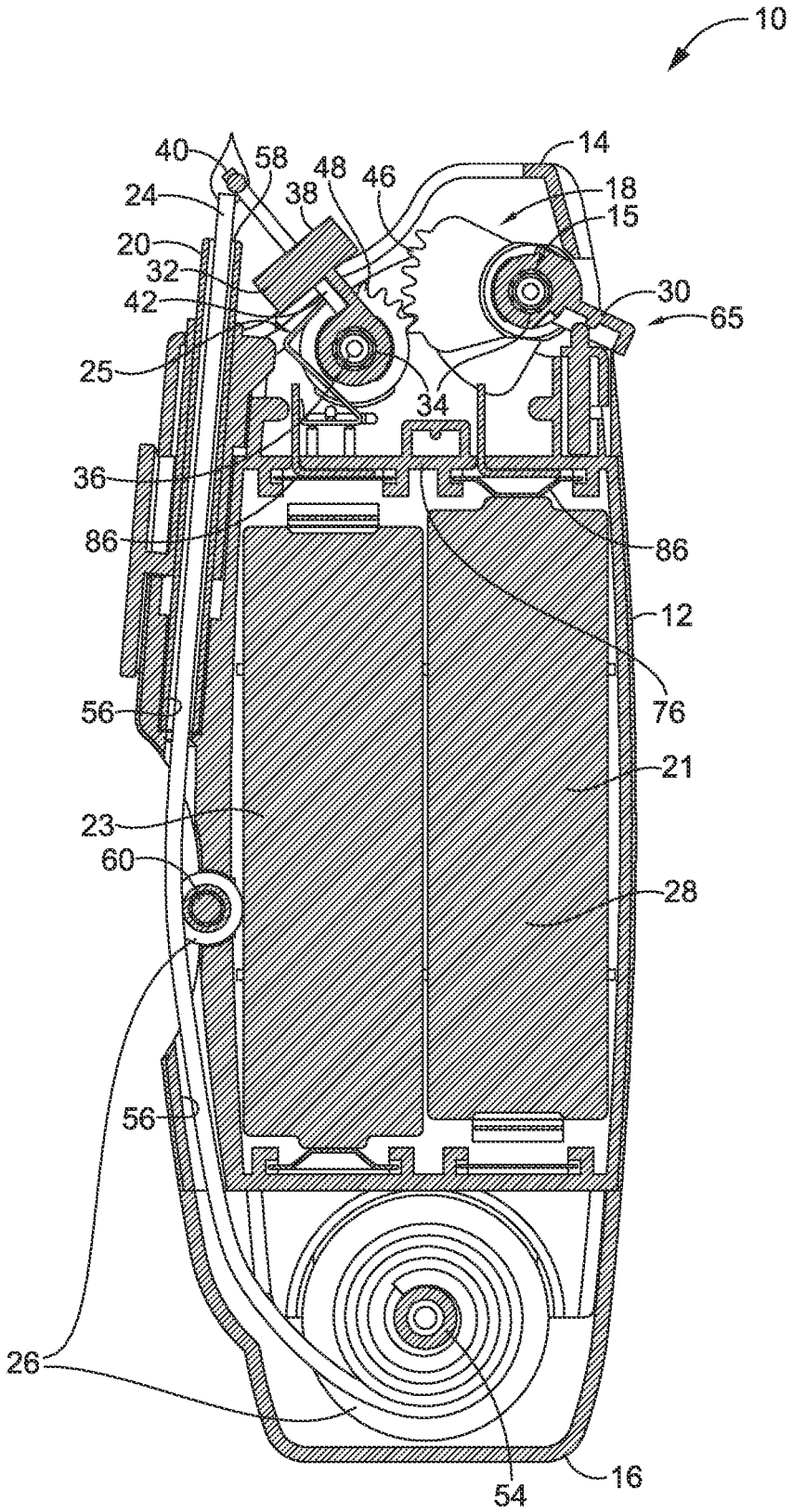

FIGS. 3A-3C depict a series of cross-sections of the igniter 10 shown in FIGS. 1-2, in accordance with an embodiment hereof. FIG. 3A depicts the igniter 10 without the ignition assembly 18 operated, or rather, in a resting state. FIG. 3B depicts the igniter 10 with the ignition assembly 18 initially operated, e.g., to facilitate ignition. FIG. 3C depicts the igniter 10 with the ignition assembly 18 operated and igniting a wick 24 fed out of the tube 20 by a wick-feeding mechanism 26.

FIGS. 3A-3C show a cross-section of the igniter 10, taken along cut-line 3-3 shown in FIGS. 1 and 2. FIGS. 3A-3C depict the ignition assembly 18 and the components thereof. FIGS. 3A-3C also depict the wick-feeding mechanism 26 and the components thereof. FIGS. 3A-3C also depict a power source 28, components of which are coupled to the ignition assembly 18. The wick-feeding mechanism 26 is coupled to the end 16 of the housing 12, and is integrated at least partially within the housing 12. The power source 28 is also integrated, at least partially, within the housing 12 between the ends 14, 16. The power source 28 includes a pair of batteries 21, 23, e.g., which may be dry-cell batteries. The batteries 21, 23 together form a battery configuration, and are electrically connected to a pair of electrical contacts 25 through a pair of electrical mounts 86 which are coupled to a support structure 76. The pair of electrical contacts 25 which are connected to the batteries 21, 23 extend generally toward the ignition assembly 18, as shown in FIGS. 3A-3C.

FIGS. 3A-3C depict how the ignition assembly 18 includes a series of adjustable, or actuatable, components. For example, the ignition assembly 18 includes a pivot-mechanism 15. The pivot-mechanism 15 includes a pivoting-element 30, a pivoting-element 32, and a pivot-hinge assembly 34 through which the pivoting-element 30 and the pivoting-element 32 are rotatably coupled/connected. This configuration allows the pivoting of one element, e.g., the pivoting-element 30, to translate into rotation of the other element, e.g., the pivoting-element 32. In the depicted embodiment, when the pivot-mechanism 15 is operated, the pivoting-elements 30, 32 rotate in opposite directions. This occurs due to a set of circumferentially-spaced teeth 46 located on the pivoting-element 30 and a set of circumferentially-spaced teeth 48 located on the pivoting-element 32, which are meshed with each other. This meshing results in rotation in opposite directions. In other embodiments, rotation/translation within the ignition assembly 18 may be facilitated using other components, e.g., linkages, gears, and/or other rotational couplings or assemblies.

Looking at FIG. 3A, it can be seen that the pivoting-element 30 of the ignition assembly 18 is exposed, at least partially, out of the housing 12. This allows the pivoting-element 30 to be operated, e.g., shifted to different positions, e.g., manually by a user of the igniter 10, e.g., using their finger. This translation of the pivoting-element 30 rotates the pivot-hinge assembly 34, which by association translates the pivoting-element 32, e.g., along a rotational arc toward the tube 20, as shown in FIGS. 3B and 3C. The pivoting-element 32 has an end 36 coupled to the pivot-hinge assembly 34, and an opposite end 38 coupled to an igniter tip 40. The igniter tip 40 is electrically conductive, and is used for ignition. The pivoting-element 32 also includes a pair of electrical contacts 42 located between the ends 36, 38. The pair of electrical contacts 42 are located so that when the pivoting-element 32 is rotated, e.g., in response to a user shifting the pivoting-element 30 from a first position shown in FIG. 3A to a second position shown in FIG. 3B, the pair of electrical contacts 42 shift into contact with the pair of electrical contacts 25, which are electrically coupled to the batteries 21, 23 of the power source 28. This direct contact completes an electrical circuit through the batteries 21, 23 and the igniter tip 40. This results in an electrical current being sent through the igniter tip 40, which increases its temperature, supporting ignition.

FIG. 3B depicts the pivoting-element 32 shifted so that there is abutting contact between the pair of electrical contacts 42 and the pair of electrical contacts 25. This completes the electrical circuit, resulting in electrical current being sent through the igniter tip 40. The igniter tip 40 is formed from electrically-conductive materials, e.g., metal formed into a wire, filament, or other conductive structure. In addition, the material(s) forming the igniter tip 40 may have a higher electrical resistance (e.g., ohms, hereinafter "Ω") than materials forming other parts of the electrical pathway between the batteries 21, 23 and the igniter tip 40. As a result, when electrical current travels through the igniter tip 40, its surface temperature increases, e.g., more quickly than other parts of the electrical pathway, increasing the temperature of the igniter tip 40 to support ignition of a material.

FIG. 3C shows the pivoting-element 30 operated, e.g., by a user of the igniter 10. In particular, the pivoting-element 30 is shifted from a first position 55, shown in FIG. 3A, to a second position 65, shown in FIG. 3C. FIG. 3C once again shows the pair of electrical contacts 42 and the pair of electrical contacts 25 in contact, completing the electrical circuit through the igniter tip 40, thereby increasing its temperature to support ignition, e.g., of the wick 24. FIG. 3C also depicts the wick-feeding mechanism 26 in detail. In FIG. 3C, the wick-feeding mechanism 26 is operated so that the wick 24 extends out of the housing 12, e.g., out of the tube 20. The igniter tip 40 has been pivoted into position to intersect with extended wick 24. This allows the heat generated by the igniter tip 40 to be transferred to the wick 24, thereby igniting it. Once the wick 24 is ignited, the pivoting-element 30 can be released, e.g., by a user of the igniter 10, so that the pivoting-element 30 travels back to its first position 55 shown in FIG. 3A. To facilitate this return to resting position, the pivot-hinge assembly 34 may include at least one biasing element that is integrated so as to bias the pivoting-element 30 back towards the first position 55. The biasing element (obscured in FIGS. 3A-3C) may be one or more springs, e.g., coil springs, coupled to the pivoting-element 30, the pivoting-element 32, and/or the pivot-hinge assembly 34. The integration of the biasing element allows the ignition assembly 18 to bias naturally towards a non-ignition state, e.g., a state in which the igniter tip 40 is not receiving any electrical current.

Looking still at FIG. 3C, the components of the wick-feeding mechanism 26 of the igniter 10 are shown in detail. The wick-feeding mechanism 26 is used to control a position of the wick 24, e.g., for the purposes of ignition, continued burning, or extinguishing. The wick-feeding mechanism 26 includes a coil structure 54 about which a length of the wick 24 may be coiled/retained, as shown in FIG. 3C. The wick-feeding mechanism 26 further includes a channel 56. The channel 56 generally extends between the coil structure 54 and an outlet 58 of the tube 20 where the wick 24 is extended/retracted to control interaction with the ignition assembly 18. FIG. 3C shows how the wick 24 extends from the coil structure 54, through the channel 56, and out of the outlet 58, with the igniter tip 40 pivoted into contact for ignition. FIG. 3C also shows a wick-shifting element 60, depicted as a roller/wheel that interacts with the wick 24. The roller/wheel can be adjusted, e.g., by a finger of a user, to extend or retract the wick 24 from the outlet 58 of the tube 20. In other embodiments, the wick-shifting element 60 may instead be another type of adjustable element, such as a slidable/translatable feature, or may simply be an opening where a user can manually impart movement to the wick 24, e.g., with their finger.

In certain embodiments, the tube 20 of the igniter 10 shown in FIGS. 3A-3C may be adjustable, e.g., slidable or translatable toward/away from the wick-shifting element 60. This adjustability of the tube 20 may facilitate controlling the wick 24 and/or facilitate controlling the ignition assembly 18. The translation of the tube 20 may be provided through operation of a mechanism coupled to the housing 12, e.g., a slider-mechanism, or may be provided manually by a user, in different instances. For example, the igniter 10 may be configured so that the tube 20, when extended, e.g., translated away from the wick-shifting element 60, interferes with operation of the ignition assembly 18, e.g., preventing translation of its components into a position that completes an electrical circuit. Then, the tube 20, when retracted, e.g., translated toward the wick-shifting element 60, allows for operation of the ignition assembly 18, e.g., allowing translation of the components that complete an electrical circuit, e.g., through the igniter tip 40, to facilitate ignition. In an alternative embodiment, the opposite configuration may be provided, i.e., extension of the tube 20 results in the non-interference position, and retraction of the tube 20 results in the interference position. In some embodiments, the tube 20 may even be extended further to facilitate extinguishing the wick 24 when it is holding a flame. In this sense, in these embodiments, the tube 20 may be translated to different positions to support different operations, e.g., preventing ignition, supporting ignition, or flame-extinguishing, among others.

Figure 4:
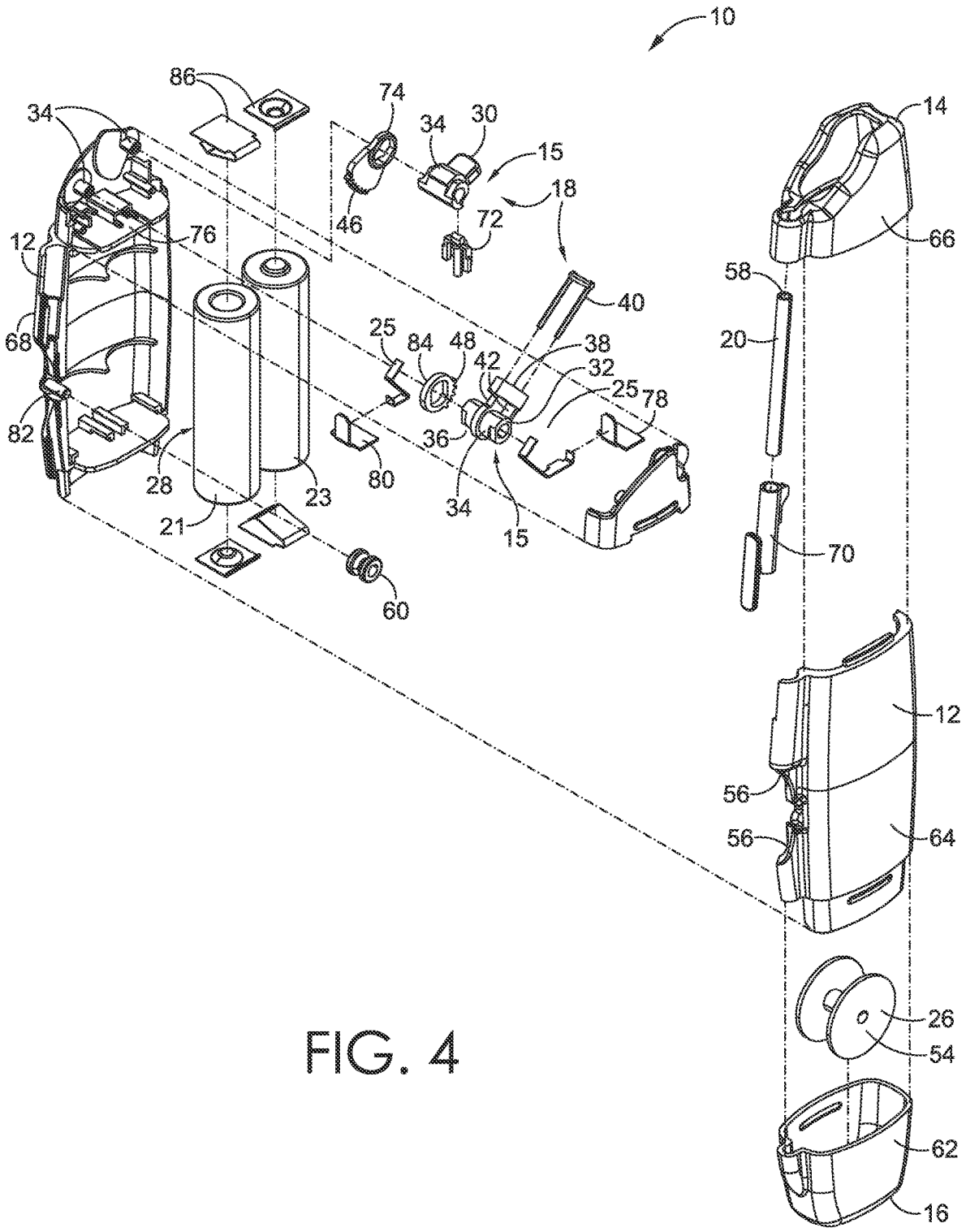
FIG. 4 depicts an exploded view of the igniter shown in FIGS. 1-2, in accordance with an embodiment of the present disclosure.

Looking now at FIG. 4, an exploded view of the igniter 10 shown in FIGS. 1-2 is provided, in accordance with an embodiment of the present disclosure. FIG. 4 depicts multiple components of the igniter 10 generally in isolation for clarity and detail purposes. For example, FIG. 4 shows the housing 12, the ignition assembly 18, the power source 28, and the wick-feeding mechanism 26, generally separated for clarity. FIG. 4 depicts how the housing 12 is assembled from multiple pieces 62, 64, 66, 68 that are assembled together. In different embodiments, a different number of pieces may define the housing 12, including more or fewer pieces, or even a single, unified, solid, singularly-formed piece, e.g., formed of recyclable or biodegradable materials, in different aspects. In some embodiments, the housings, e.g., the housing 12, and/or any components thereof, e.g., the pieces 62, 64, 66, 68, described herein may be formed from different biodegradable materials, e.g., such as biodegradable resins, or biomass (bio-based) resins that are obtained, at least in part, from renewable raw materials, such as plants or other biological sources. FIG. 4 also depicts the coil structure 54 of the wick-feeding mechanism 26, about which a length of wick can be coiled/stored. The channel 56, the outlet 58, and a supporting enclosure 70, as well as the wick-shifting element 60 and a corresponding support 82 for the wick-shifting element 60, are also depicted in FIG. 4.

FIG. 4 also shows the pivot-mechanism 15 of the ignition assembly 18 in exploded form, in accordance with an embodiment of the present disclosure. FIG. 4 shows how the pivot-mechanism 15 includes the pivoting-element 30 which sits on a mount 72 and includes a gear 74 where the plurality of circumferentially-spaced teeth 46 are located. FIG. 4 also shows how the pivot-mechanism 15 includes the pivoting-element 32 which has the end 36 coupled to the pivot-hinge assembly 34 and the end 38 coupled to the igniter tip 40. The pair of electrical contacts 42 coupled to the pivoting-element 32 are also shown. The pivoting-element 32 also includes a gear 84 where the plurality of circumferentially-spaced teeth 48 are located. When the igniter 10 is assembled, the teeth 46, 48 are aligned and meshed. FIG. 4 also shows the pair of electrical contacts 25 of the ignition assembly 18. The pair of electrical contacts 25 are coupled to, and mounted on, respective circuit components 78, 80 which upon assembly are mounted to a support structure 76. The support structure 76 is further seated on a pair of electrical mounts 86 that electrically couple the power source 28, e.g., batteries 21, 23 thereof, to the ignition assembly 18.

Figure 5A:
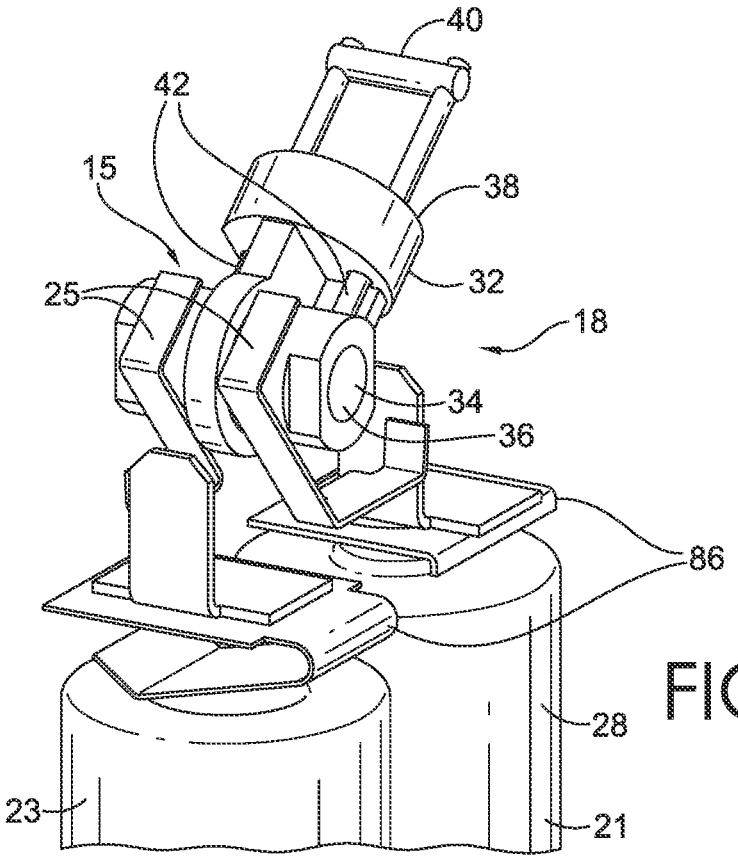
FIGS. 5A-5B depict part of an ignition assembly and power source in isolation, in accordance with an embodiment of the present disclosure.
Figure 5B:
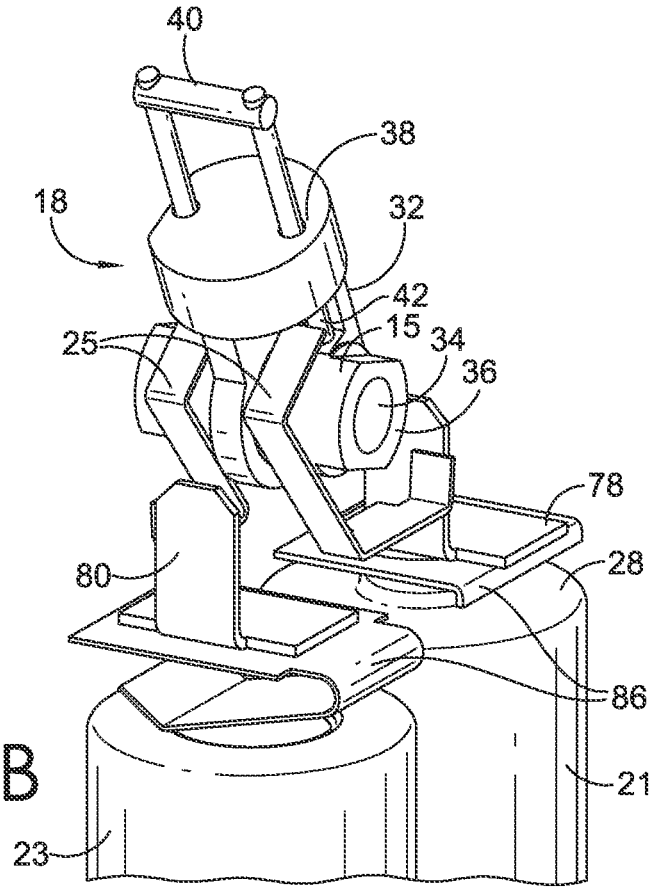

FIGS. 5A-5B depict part of the ignition assembly 18 of the igniter 10 in isolation, in accordance with an embodiment of the present disclosure. FIG. 5A shows the ignition assembly 18 in one state of operation. FIG. 5B shows the ignition assembly 18 in another state of operation, e.g., in an ignition-state. It should be clear that FIGS. 5A-5B depict only part of the ignition assembly 18 and the pivot-mechanism 15, and primarily show the igniter tip 40, the pivoting-element 32, the pivot-hinge assembly 34, the circuit components 78, 80, and the electrical mounts 86 that connect the batteries 21, 23 to the ignition assembly 18. FIGS. 5A-5B depict these components in isolation to illustrate the electrical coupling that extends from the batteries 21, 23, through the ignition assembly 18, and ultimately to the igniter tip 40, when the pivot-mechanism 15 is operated as shown in FIG. 5B. Accordingly, when the pivoting-element 32 is shifted so that the pair of electrical contacts 42 are in contact with the pair of electrical contacts 25, an electrical circuit is completed along the pathway from the batteries 21, 23 to the igniter tip 40. In alternative embodiments, certain components, e.g., such as components 78, 80, 86, 25 shown in FIG. 4, and/or other components, including different combinations of the same, may be formed or manufactured as a single, unified, integral component, rather than as multiple separate components that are assembled together. For example, in one embodiment, components 25, 78, 80, 86 may be manufactured as a single, unified, integral component for the igniter 10, rather than as separate components that are combined, as shown in FIG. 4.

FIG. 5A shows the ignition assembly 18 with the pivoting-element 32 in a non-ignition configuration, which may be a biased state (e.g., a state resulting from bias applied by a biasing element coupled to the pivot-hinge assembly 34). FIG. 5B shows the ignition assembly 18 with the pivoting-element 32 in an ignition configuration, with the pivoting-element 32 rotated so that the pair of electrical contacts 42 is translated into contact with the pair of electrical contacts 25, which may be a counter-biased state (e.g., a state resulting from a counteracting force being applied against the biasing element, e.g., by a user). In the configuration shown in FIG. 5B, the igniter tip 40 is in a completed circuit with the batteries 21, 23, and is generating heat that can be used to ignite a material, e.g., a wick, such as the wick 24.

Figure 6B:
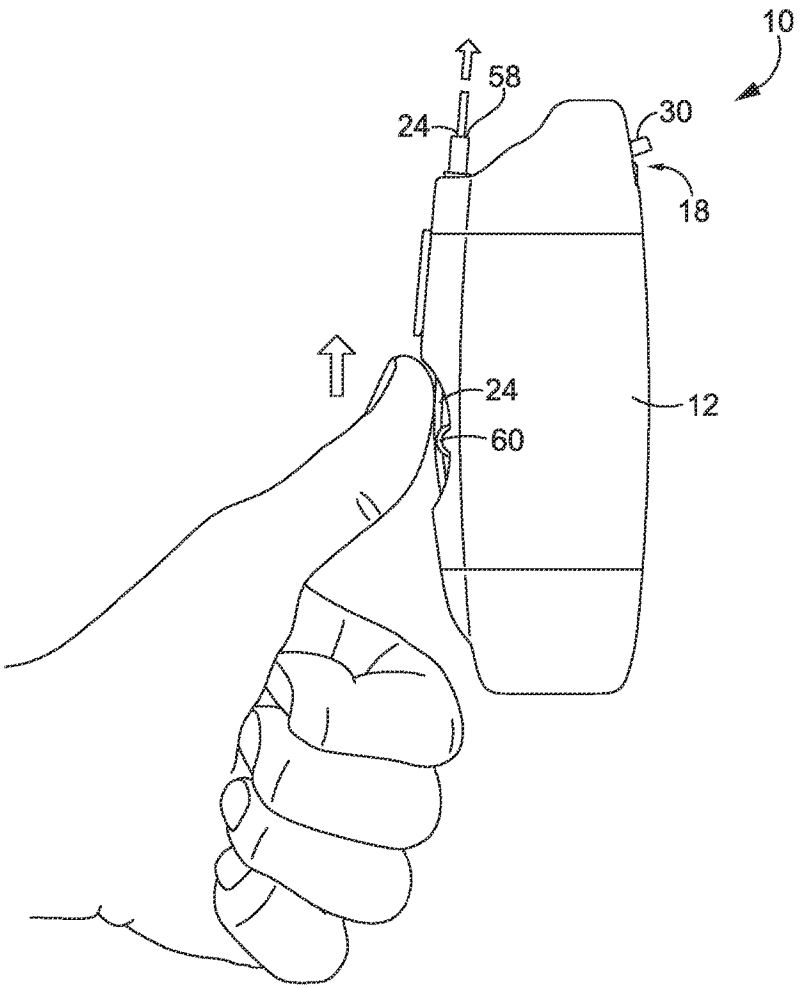
FIGS. 6A-6B depict a user operating an igniter, in accordance with an embodiment of the present disclosure.
Figure 6A:
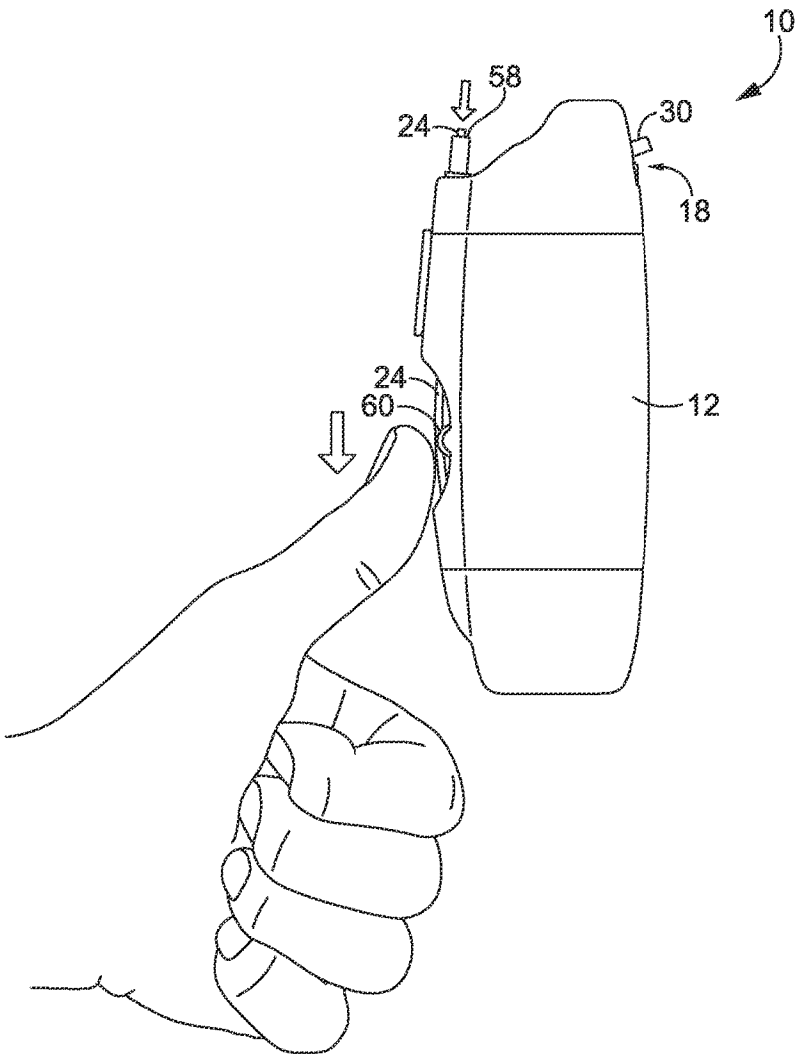

Looking now at FIGS. 6A-6B, the igniter 10 of FIGS. 1-2 is again shown, depicting a manipulation that shifts the wick 24, in accordance with an embodiment of the present disclosure. FIG. 6A shows a user operating the wick-shifting element 60, shown as a wheel, but which may also be a slider, or simply an opening in different embodiments, depending on the configuration. This manipulation shifts the wick 24 into the outlet 58 from which the wick 24 has been extended. This shifting into the outlet 58 may facilitate extinguishing of a flame maintained by the wick 24. FIG. 6B shows a user operating the wick-shifting element 60 to shift the wick 24 out of the outlet 58 from which the wick 24 has been extended. This shifting out of the outlet 58, to expose more of the wick 24, may facilitate ignition by the ignition assembly 18 as discussed herein, or may facilitate sustaining a flame as the wick 24 is burned, by feeding out more wick 24.

Figure 7:
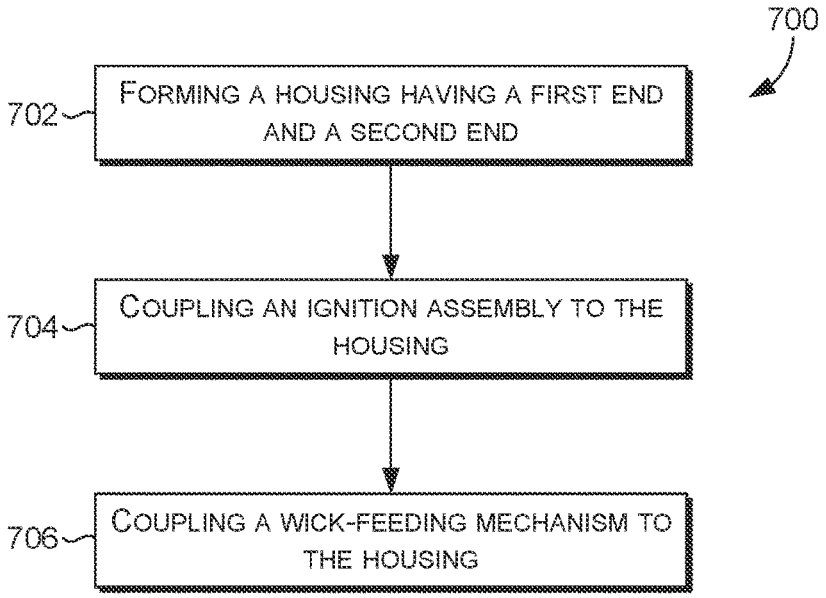
FIG. 7 depicts a block diagram of a method of manufacturing an igniter, in accordance with an embodiment hereof.

Looking now at FIG. 7, a block diagram of an example method 700 of manufacturing an igniter, such as the igniter 10 shown in FIGS. 1-2, is provided, in accordance with an embodiment of the present disclosure. The method 700 includes, but is not limited to, blocks 702-706, shown in FIG. 7. In block 702, the method includes forming a housing, e.g., the housing 12 shown in FIGS. 1-2, having a first end, e.g., the end 14 shown in FIGS. 1-2, and a second end, e.g., the end 16 shown in FIGS. 1-2. In block 704, the method includes coupling an ignition assembly, e.g., the ignition assembly 18 shown in FIGS. 3A-3C and FIGS. 5A-5B, to the housing. The ignition assembly may include at least one battery, e.g., the batteries 21, 23 shown in FIGS. 3A-3C, a first pair of electrical contacts, e.g., the pair of electrical contacts 25 shown in FIGS. 5A-5B, coupled to the at least one battery, and a pivot-mechanism, e.g., the pivot-mechanism 15 shown in FIGS. 3A-3C, comprising a first pivoting-element, e.g., the pivoting-element 30 shown in FIGS. 3A-3C, a second pivoting-element, e.g., the pivoting-element 32 shown in FIGS. 3A-3C, and a pivot-hinge assembly, e.g., the pivot-hinge assembly 34 shown in FIGS. 3A-3C, through which the first pivoting-element and the second pivoting-element are rotatably coupled, wherein the first pivoting-element includes a first end coupled to the pivot-hinge assembly and a second end that is shiftable between a first position and a second position, wherein the second pivoting-element includes a first end coupled to the pivot-hinge assembly, a second end coupled to an igniter tip, e.g., the igniter tip 40 shown in FIGS. 3A-3C and FIGS. 5A-5B, and a second pair of electrical contacts, e.g., the pair of electrical contacts 42 shown in FIGS. 3A-3C, coupled between the first end and the second end of the second pivoting-element. In block 706, the method includes coupling a wick-feeding mechanism, e.g., the wick-feeding mechanism 26 shown in FIG. 3C, to the housing.

Figure 8:
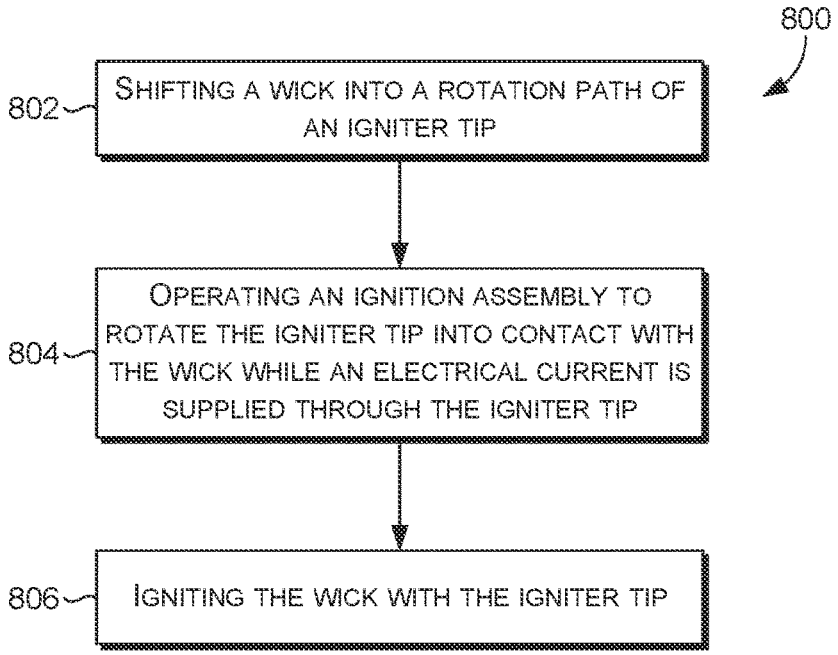
FIG. 8 depicts a block diagram of a method of operating an igniter, e.g., for testing or use purposes, in accordance with an embodiment hereof.

Looking now at FIG. 8, a block diagram of an example method 800 of operating an igniter is provided, in accordance with an embodiment of the present disclosure. The method 800 includes, but is not limited to, blocks 802-806, shown in FIG. 8. In block 802, the method includes shifting a wick, e.g., the wick 24 shown in FIG. 3C, into a rotation path of an igniter tip, e.g., the igniter tip 40 shown in FIGS. 3A-3C. In block 804, the method includes operating an ignition assembly, e.g., the ignition assembly 18 shown in FIGS. 3A-3C, to rotate the igniter tip into contact with the wick while an electrical current is supplied through the igniter tip, e.g., through completion of an electrical circuit as described in connection with FIGS. 5A-5B herein. In block 806, the method includes igniting the wick with the igniter tip, e.g., as shown in FIG. 3C.

Embodiment 1. An igniter comprising a housing comprising a first end and a second end; an ignition assembly coupled to the housing and comprising at least one battery, a first pair of electrical contacts coupled to the at least one battery and extending toward the first end of the housing, and a pivot-mechanism comprising a first pivoting-element, a second pivoting-element, and a pivot-hinge assembly through which the first pivoting-element and the second pivoting-element are rotatably coupled, wherein the first pivoting-element includes a first end coupled to the pivot-hinge assembly, and a second end that is shiftable between a first position and a second position, wherein the second pivoting-element includes a first end coupled to the pivot-hinge assembly, a second end coupled to an igniter tip, and a second pair of electrical contacts coupled between the first end of the second pivoting-element and the second end of the second pivoting-element, and wherein, when the first pivoting-element is shifted from the first position to the second position, the pivot-hinge assembly translates the second pivoting-element so that the second pair of electrical contacts comes into contact with the first pair of electrical contacts, thereby completing an electrical circuit through the at least one battery and the igniter tip; and a wick-feeding mechanism coupled to the housing.

Embodiment 2. The igniter of embodiment 1, wherein the first pivoting-element comprises a first plurality of circumferentially-spaced teeth, wherein the second pivoting-element comprises a second plurality of circumferentially-spaced teeth, and wherein the first plurality of circumferentially-spaced teeth and the second plurality of circumferentially-spaced teeth are meshed such that the first pivoting-element and the second pivoting-element rotate in opposite directions.

Embodiment 3. The igniter of embodiment 1 or 2, further comprising a wick coupled to the wick-feeding mechanism, wherein the wick is extendable and retractable through operation of the wick-feeding mechanism.

Embodiment 4. The igniter of any of embodiments 1-3, wherein the wick-feeding mechanism comprises a coil structure; a channel for receiving the wick extending from the coil structure; an outlet through which the wick is extendable and retractable; and a wick-shifting element operable to shift the wick through the channel.

Embodiment 5. The igniter of any of embodiments 1-4, wherein the wick-shifting element is a roller coupled to the housing adjacent to the channel, wherein rotation of the roller shifts the wick in the channel.

Embodiment 6. The igniter of any of embodiments 1-5, wherein the igniter tip comprises an electrically-conductive wire or filament that extends between the second pair of electrical contacts.

Embodiment 7. The igniter of any of embodiments 1-6, wherein the at least one battery comprises a pair of dry-cell batteries, and wherein the pair of dry-cell batteries are supported in a battery enclosure located within the housing, and wherein the pair of dry-cell batteries are removable.

Embodiment 8. The igniter of any of embodiments 1-7, further comprising a hemp wick coupled to the wick-feeding mechanism.

Embodiment 9. The igniter of any of embodiments 1-8, wherein the housing is formed of a material that is biodegradable and/or recyclable.

Embodiment 10. The igniter of any of embodiments 1-9, further comprising a biasing element coupled to the ignition assembly, wherein the biasing element biases the second end of the first pivoting-element towards the first position.

Embodiment 11. A method of manufacturing an igniter, the method comprising forming a housing having a first end and a second end; coupling an ignition assembly to the housing, the ignition assembly comprising at least one battery, a first pair of electrical contacts coupled to the at least one battery, and a pivot-mechanism comprising a first pivoting-element, a second pivoting-element, and a pivot-hinge assembly through which the first pivoting-element and the second pivoting-element are rotatably coupled, wherein the first pivoting-element includes a first end coupled to the pivot-hinge assembly, and a second end that is shiftable between a first position and a second position, wherein the second pivoting-element includes a first end coupled to the pivot-hinge assembly, a second end coupled to an igniter tip, and a second pair of electrical contacts coupled between the first end of the second pivoting-element and the second end of the second pivoting-element, and wherein, when the first pivoting-element is shifted from the first position to the second position, the pivot-hinge assembly translates the second pivoting-element so that the second pair of electrical contacts comes into contact with the first pair of electrical contacts, thereby completing an electrical circuit through the at least one battery and the igniter tip; and coupling a wick-feeding mechanism to the housing.

Embodiment 12. The method of embodiment 11, wherein the first pivoting-element comprises a first plurality of circumferentially-spaced teeth, wherein the second pivoting-element comprises a second plurality of circumferentially-spaced teeth, and wherein the first plurality of circumferentially-spaced teeth and the second plurality of circumferentially-spaced teeth are meshed such that the first pivoting-element and the second pivoting-element rotate in opposite directions.

Embodiment 13. The method of embodiment 11 or 12, further comprising coupling a coil-spring to the pivot-hinge assembly so that it biases the second end of the first pivoting-element toward the first position.

Embodiment 14. The method of any of embodiments 11-13, further comprising coupling a wick to the wick-feeding mechanism, such that the wick is extendable and retractable through operation of the wick-feeding mechanism.

Embodiment 15. The method of any of embodiments 11-14, wherein the wick-feeding mechanism comprises a coil structure; a channel for receiving the wick extending from the coil structure; an outlet through which the wick is extendable and retractable; and a wick-shifting element operable to shift the wick through the channel.

Embodiment 16. The method of any of embodiments 11-15, wherein the wick-feeding mechanism includes a tube that defines at least part of the channel, wherein the tube is extendable and retractable to thereby change a position of the outlet in relation to the ignition assembly.

Embodiment 17. The method of any of embodiments 11-16, wherein the igniter tip comprises an electrically-conductive wire or filament that extends between the second pair of electrical contacts.

Embodiment 18. The method of any of embodiments 11-17, wherein the housing is formed of a material that is biodegradable and/or recyclable.

Embodiment 19. The method of any of embodiments 11-18, wherein the igniter tip pivots along a circular arc when the ignition assembly is operated by shifting the second end of the first pivoting-element from the first position to the second position.

Embodiment 20. An igniter comprising a housing having a first end and a second end; a power source coupled within the housing and between the first end and the second end; an ignition assembly coupled to the housing and comprising a pivoting-element having a first pair of electrical contacts that are electrically coupled to an igniter tip, and a support structure having a second pair of electrical contacts that are electrically coupled to the power source, wherein the ignition assembly is operable to shift the igniter tip located on the pivoting-element from a first position to a second position where the first pair of electrical contacts comes into contact with the second pair of electrical contacts, thereby completing an electrical circuit through the power source and the igniter tip.

Embodiment 21. A method of operating an igniter that comprises a housing, at least one battery, an ignition assembly, an igniter tip, and a wick, whereon the ignition assembly is operable to send an electrical current through the igniter tip while it is in contact with the wick, the method comprising shifting the wick into a rotation path of the igniter tip; operating the ignition assembly to rotate the igniter tip into contact with the wick while an electrical current is supplied through the igniter tip; and igniting the wick with the igniter tip.

Embodiment 22. An igniter comprising a housing; a power source coupled to the housing; an ignition assembly coupled to the housing, the ignition assembly comprising an electric heating wire, the ignition assembly operable to complete an electrical circuit through the power source and the electric heating wire; and a hemp wick coupled to the housing and ignitable with the electric heating wire.

Embodiment 23. The preceding embodiments 1-22 in any combination.

In some embodiments, this disclosure may include the language, for example, "at least one of [element A] and [element B]." This language may refer to one or more of the elements. For example, "at least one of A and B" may refer to "A," "B," or "A and B." In other words, "at least one of A and B" may refer to "at least one of A and at least one of B," or "at least either of A or B." In some embodiments, this disclosure may include the language, for example, "[element A], [element B], and/or [element C]." This language may refer to either of the elements or any combination thereof. In other words, "A, B, and/or C" may refer to "A," "B," "C," "A and B," "A and C," "B and C," or "A, B, and C." In addition, this disclosure may use the term "and/or" which may refer to any one or combination of the associated elements.

The subject matter of this disclosure has been described in relation to particular embodiments, which are intended in all respects to be illustrative rather than restrictive. Alternative embodiments will become apparent to those of ordinary skill in the art to which the present subject matter pertains without departing from the scope hereof. Different combinations and sub-combinations of elements, as well as use of elements not shown, are also possible and contemplated herein.

What is claimed is:

1. An igniter, comprising:

a housing, comprising:

a first end, and a second end;

an ignition assembly coupled to the housing and comprising:

at least one battery, a first pair of electrical contacts coupled to the at least one battery and extending toward the first end of the housing, and a pivot-mechanism comprising a first pivoting-element, a second pivoting-element, and a pivot-hinge assembly through which the first pivoting-element and the second pivoting-element are rotatably coupled, wherein the first pivoting-element includes:

a first end coupled to the pivot-hinge assembly, and a second end that is shiftable between a first position and a second position, wherein the second pivoting-element includes:

a first end coupled to the pivot-hinge assembly, a second end coupled to an igniter tip, and a second pair of electrical contacts coupled between the first end of the second pivoting-element and the second end of the second pivoting-element, and wherein, when the first pivoting-element is shifted from the first position to the second position, the pivot-hinge assembly translates the second pivoting-element so that the second pair of electrical contacts comes into contact with the first pair of electrical contacts, thereby completing an electrical circuit through the at least one battery and the igniter tip; and a wick-feeding mechanism coupled to the housing.

2. The igniter of claim 1, wherein the first pivoting-element comprises a first plurality of circumferentially-spaced teeth, wherein the second pivoting-element comprises a second plurality of circumferentially-spaced teeth, and wherein the first plurality of circumferentially-spaced teeth and the second plurality of circumferentially-spaced teeth are meshed such that the first pivoting-element and the second pivoting-element rotate in opposite directions.

3. The igniter of claim 1, further comprising a wick coupled to the wick-feeding mechanism, wherein the wick is extendable and retractable through operation of the wick-feeding mechanism.

4. The igniter of claim 3, wherein the wick-feeding mechanism comprises:

a coil structure;

a channel for receiving the wick extending from the coil structure;

an outlet through which the wick is extendable and retractable; and a wick-shifting element operable to shift the wick through the channel.

5. The igniter of claim 4, wherein the wick-shifting element is a roller coupled to the housing adjacent to the channel, wherein rotation of the roller shifts the wick in the channel.

6. The igniter of claim 1, wherein the igniter tip comprises an electrically-conductive wire or filament that extends between the second pair of electrical contacts.

7. The igniter of claim 1, wherein the at least one battery comprises a pair of dry-cell batteries, and wherein the pair of dry-cell batteries are supported in a battery enclosure located within the housing, and wherein the pair of dry-cell batteries are removable.

8. The igniter of claim 1, further comprising a hemp wick coupled to the wick-feeding mechanism.

9. The igniter of claim 1, wherein the housing is formed of a material that is biodegradable and/or recyclable.

10. The igniter of claim 1, further comprising a biasing element coupled to the ignition assembly, wherein the biasing element biases the second end of the first pivoting-element towards the first position.

11. A method of manufacturing an igniter, the method comprising:

forming a housing having a first end and a second end;

coupling an ignition assembly to the housing, the ignition assembly comprising:

at least one battery, a first pair of electrical contacts coupled to the at least one battery, and a pivot-mechanism comprising a first pivoting-element, a second pivoting-element, and a pivot-hinge assembly through which the first pivoting-element and the second pivoting-element are rotatably coupled, wherein the first pivoting-element includes:

a first end coupled to the pivot-hinge assembly, and a second end that is shiftable between a first position and a second position, wherein the second pivoting-element includes:

a first end coupled to the pivot-hinge assembly, a second end coupled to an igniter tip, and a second pair of electrical contacts coupled between the first end of the second pivoting-element and the second end of the second pivoting-element, and wherein, when the first pivoting-element is shifted from the first position to the second position, the pivot-hinge assembly translates the second pivoting-element so that the second pair of electrical contacts comes into contact with the first pair of electrical contacts, thereby completing an electrical circuit through the at least one battery and the igniter tip; and coupling a wick-feeding mechanism to the housing.

12. The method of claim 11, wherein the first pivoting-element comprises a first plurality of circumferentially-spaced teeth, wherein the second pivoting-element comprises a second plurality of circumferentially-spaced teeth, and wherein the first plurality of circumferentially-spaced teeth and the second plurality of circumferentially-spaced teeth are meshed such that the first pivoting-element and the second pivoting-element rotate in opposite directions.

13. The method of claim 11, further comprising coupling a coil-spring to the pivot-hinge assembly so that it biases the second end of the first pivoting-element toward the first position.

14. The method of claim 11, further comprising coupling a wick to the wick-feeding mechanism, such that the wick is extendable and retractable through operation of the wick-feeding mechanism.

15. The method of claim 14, wherein the wick-feeding mechanism comprises:

a coil structure;

a channel for receiving the wick extending from the coil structure;

an outlet through which the wick is extendable and retractable; and a wick-shifting element operable to shift the wick through the channel.

16. The method of claim 15, wherein the wick-feeding mechanism includes a tube that defines at least part of the channel, wherein the tube is extendable and retractable to thereby change a position of the outlet in relation to the ignition assembly.

17. The method of claim 11, wherein the igniter tip comprises an electrically-conductive wire or filament that extends between the second pair of electrical contacts.

18. The method of claim 11, wherein the housing is formed of a material that is biodegradable and/or recyclable.

19. The method of claim 11, wherein the igniter tip pivots along a circular arc when the ignition assembly is operated by shifting the second end of the first pivoting-element from the first position to the second position.

20. An igniter, comprising:

a housing;

a power source coupled to the housing;

an ignition assembly coupled to the housing, the ignition assembly comprising an electric heating wire, the ignition assembly operable to complete an electrical circuit through the power source and the electric heating wire; and a hemp wick coupled to the housing and ignitable with the electric heating wire without combustion of petroleum-based gas or liquid fuel.

* * * * *